US009812266B2

(12) United States Patent
Hung et al.

(10) Patent No.: US 9,812,266 B2
(45) Date of Patent: Nov. 7, 2017

(54) SWITCH CONTROL MODULE

(71) Applicant: Wistron NeWeb Corp., Hsinchu (TW)

(72) Inventors: Tien-Chun Hung, Hsinchu (TW); Jen-Yung Chang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 23 days.

(21) Appl. No.: 14/824,890

(22) Filed: Aug. 12, 2015

(65) Prior Publication Data

US 2016/0163473 A1 Jun. 9, 2016

(30) Foreign Application Priority Data

Dec. 3, 2014 (TW) ..... 103141947 A

(51) Int. Cl.

| | |
|---|---|
| ***H01H 3/00*** | (2006.01) |
| ***H01H 5/00*** | (2006.01) |
| ***H01H 9/04*** | (2006.01) |
| ***H01H 9/22*** | (2006.01) |
| *H01H 3/20* | (2006.01) |
| *H01H 19/03* | (2006.01) |

(52) U.S. Cl.

CPC ..... *H01H 9/04* (2013.01); *H01H 9/22* (2013.01); *H01H 3/20* (2013.01); *H01H 19/03* (2013.01)

(58) Field of Classification Search

CPC .. H01H 9/04; H01H 9/22; H01H 3/20; H01H 19/03

USPC ..... 200/302.1, 330–332, 335–337, 50.11, 200/50.19

See application file for complete search history.

(56) References Cited

U.S. PATENT DOCUMENTS

| | | | | |
|---|---|---|---|---|
| 5,159,706 | A * | 10/1992 | Hodsdon | H04B 1/38 200/11 R |
| 9,384,920 | B1 * | 7/2016 | Bakulich | H03J 5/10 |
| 2005/0167255 | A1 * | 8/2005 | Howie | H01H 19/03 200/336 |

FOREIGN PATENT DOCUMENTS

| | | |
|---|---|---|
| CN | 201066644 Y | 5/2008 |
| TW | M316486 U | 8/2007 |
| TW | I435686 B | 4/2014 |

* cited by examiner

*Primary Examiner* — Renee Luebke
*Assistant Examiner* — Lheiren Mae A Caroc
(74) *Attorney, Agent, or Firm* — McClure, Qualey & Rodack, LLP

(57) ABSTRACT

A switch control module is provided, which includes housing, a control assembly, a linkage unit, and a number of positioning units. The housing defines an accommodating space and has an opening. The control assembly is positioned in the accommodating space and has a shaft that is rotatable about a main axis. The linkage unit passes through the opening and is connected to the shaft in a movable manner. The positioning units are positioned at the edge of the opening. Each of the positioning units extends radially and outwardly with the main axis as a center and is projected in a direction along the main axis. The linkage unit is selectively connected to one of the positioning units and is configured to drive the shaft to rotate so as to change the operation of the control module.

10 Claims, 7 Drawing Sheets

SWITCH CONTROL MODULE

CROSS REFERENCE TO RELATED APPLICATIONS

This Application claims priority of Taiwan Patent Application No. 103141947, filed on Dec. 3, 2014, the entirety of which is incorporated by reference herein.

BACKGROUND

Field of the Invention

The present invention relates to a switch control module for changing the settings of the device, and more particularly to a switch control module having tamperproof and waterproof switch control module.

Description of the Related Art

Devices such as water gauges and electric meters that are fixed in a particular location are often equipped a switch that enables people who have authorization to change the settings of the device. To prevent unauthorized personnel from changing the settings of such a device, the device is generally placed behind a protective cover. A number of retainer bolts are used to seal the protective cover, and a lead seal is normally connected through the retainer bolts to prevent tampering. However, the arrangement of the protective, covers may enlarge the size of the device and adversely increase the cost.

To solve the above problems, some devices are equipped with tamperproof switches. However, such switches are only capable of performing limited operations. Performing a complicated change of settings will inevitably ruin the device. This may cause damage to the elements in the device due to the effects of environmental moisture.

Therefore, a tamperproof and waterproof switch control module that can be used to change complicated settings on a device is desired.

SUMMARY

One objective of the present invention is to provide a switch control module which is used to control a device being operated in multiple operation modes. In addition, the switch control module has a tamperproof quality to prevent people who have no authorization from disassembling the device and changing the settings on the device. Moreover, the switch control module is waterproof, and therefore the device is more durable.

According to one embodiment of the disclosure, the switch control module includes a housing, a control assembly, a linkage unit, and a number of positioning units. The housing defines an accommodating space and has an opening. The control assembly is disposed in the accommodating space and includes a shaft that is rotatable about a main axis, wherein the main axis passes through the opening. The linkage unit passes through the opening and is connected to the shaft in a movable manner. The positioning units are located at an edge of the opening and spaced apart from one another, wherein the positioning units extend radially and outwardly with the main axis as a center and are projected in a direction along the main axis. The linkage unit is configured to drive the shaft to rotate so as to change the operation mode of the control module, and is selectively connected to one of the positioning units.

In the embodiment, the linkage unit includes a rod, a holding pin, and a an abutting structure. The rod has a first end and a second end opposite the first end, wherein the first end of the rod is connected to the shaft in a movable manner, and the second end of the rod passes through the opening. The holding pin pivots at the second end of the rod and is selectively connected to one of the positioning units. The abutting structure surrounds the rod. While the holding pin is being placed into one of the positioning units, the abutting structure moves away from the control assembly so as to seal the opening.

In the embodiment, the first end of the rod includes an inserting hole extending along the main axis, and the shaft is connected to the rod via the inserting hole in such a way that it is capable of sliding alone the main axis.

In the embodiment, each of the positioning units includes a locking hole, and the holding pin includes a through hole, when the holding pin is positioned in one of the positioning units, the through hole of the holding pin communicates with the locking hole of the corresponding positioning unit for facilitating insertion of a fastening member to fix the holding pin in the corresponding positioning unit.

In the embodiment, each of the positioning units includes a pivot point located at the edge of the opening, and while the holding pin is being placed into one of the positioning units by pivoting the holding pin about the rod, the holding pin abuts the pivot point, and the rod is moved away from the shaft.

In the embodiment, the linkage unit further includes a sealing member arranged adjacent to the abutting structure and surrounding the rod, when the holding pin is connected to one of the positioning units, the sealing member is compressed by the abutting structure so as to seal the opening. The sealing member is made of deformable elastic material.

In the embodiment, each of the positioning units includes a groove extending away from the opening and radially extending relative to the main axis.

In the embodiment, the linkage unit is connected to one of the positioning units by placing the linkage unit into the corresponding groove.

BRIEF DESCRIPTION OF THE DRAWINGS

For a more complete understanding of the embodiments, and the advantages thereof, reference is now made to the following descriptions taken in conjunction with the accompanying drawings.

DESCRIPTION OF THE ILLUSTRATIVE EMBODIMENTS

In the following description, a multi-view auto-stereoscopic display of the present invention will be explained with reference to embodiments thereof. It should be appreciated that these embodiments are not intended to limit the present invention to any specific environment, applications or particular implementations described in these embodiments. Therefore, the description of these embodiments is only for the purpose of illustration rather than to limit the present invention. Furthermore, the attached drawings may be drawn in a slightly simplified or exaggerated way for ease of understanding; the numbers, shapes and dimensional scales of elements depicted may not be exactly the same as those in practical implementation and are not intended to limit the present invention.

Figure 1:
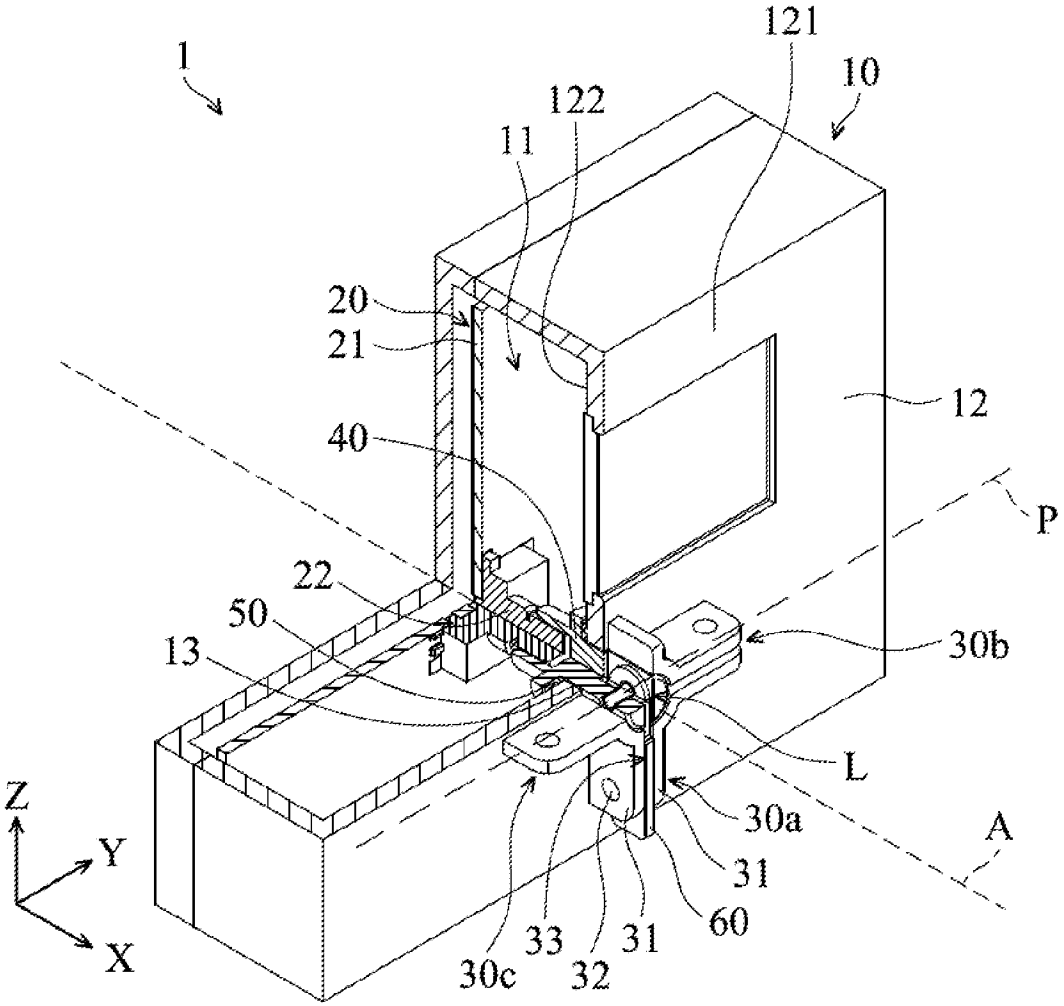
FIG. 1 shows a cross-sectional vie of a switch control module accordance with one embodiment of the disclosure.
Figure 2:
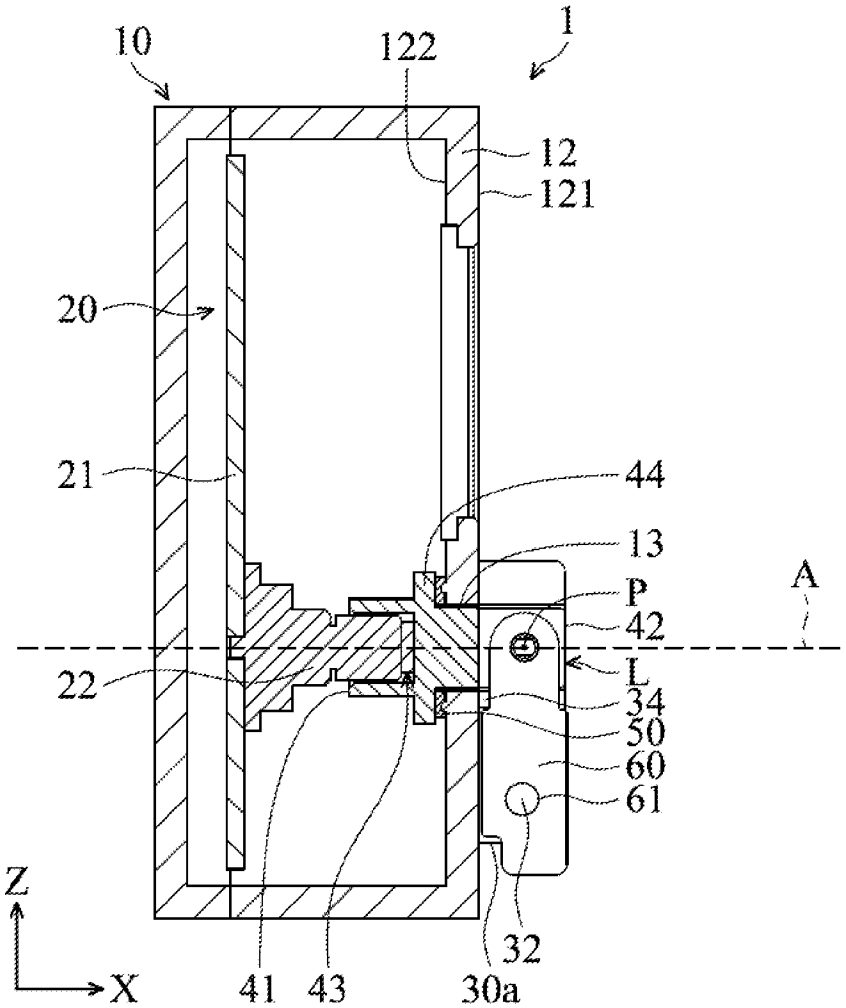
FIG. 2 shows a cross-sectional view of a switch control module with a linkage unit being fixed by a fastening member, in accordance with one embodiment of the disclosure.

FIGS. 1 and 2 show cross sectional views of a switch control module 1. The switch control module 1 is adapted to be connected to a device (such as water gauge or electric meter) and is configured to control the operation of the device. In the embodiment, the switch control module 1 includes a housing 10, a control assembly 20, a number of positioning units 30*a*, 30*b*, and 30*c*, and a linkage unit L. Elements of the switch control module 1 can be added or omitted in other embodiments and should not limit the embodiment.

In the embodiment, an accommodating space 11 is defined by the housing 10. The housing 10 includes a panel 12, an opening 13 penetrating a front surface 121 and a rear surface 122 of the panel 12 along a main axis A.

In the embodiment, the control assembly 20 is positioned in the accommodating space 11 and includes a substrate 21 and a shaft 22. The substrate 21 such as a circuit board) is connected to other elements (such as a controller) of the switch control module 1, so as to change the operation mode of the device. The shaft 22 is positioned on the substrate 21 and is rotatable around the main axis A. According to the rotation angle of the shaft 22, the control assembly 20 is switched between different operation modes. For example, when the holding pin 60 is positioned in a first positioning unit 30*a*, the linkage unit L limits the rotation angle of the shaft 22 of the control assembly 20 at an angle of 0 degrees, and the control assembly 20 is operated in a first operation mode. When the holding pin 60 is positioned in a second positioning unit 30*b*, the linkage unit L limits the rotation angle of the shaft 22 of the control assembly 20 at an angle of 90 degrees, and the control assembly 20 is operated in a second operation mode. When the holding pin 60 is positioned in a third positioning unit 30*c*, the linkage unit L limits the rotation angle of the shaft 22 of the control assembly 20 at an angle of −90 degrees, and the control assembly 20 is operated in a third operation mode. It should be noted that the control assembly 20 can be operated in different operation modes according to other rotation angles of the shaft 22, and is not meant to be limiting to the embodiment.

In the embodiment, the switch control module 1 includes three positioning units, such as the first positioning unit 30*a*, the second positioning unit 30*b*, and the third positioning unit 30*c*. The first, second, and third positioning units 30*a*, 30*b*, and 30*c* are located at the edge of the opening 13 and positioned on the front surface 121 of the panel 12 in such a way that the positioning units are spaced apart from one another. Each of the first, second, and third positioning units 30*a*, 30*b*, and 30*c* radially extends outwardly with the main axis A as a center and protrudes in the X direction along the main axis A. For example, as shown in FIG. 1, the first positioning unit 30*a* extends outwardly relative to the main axis A from the bottom side of the opening 13 and protrudes in the X direction along the main axis A. The second positioning unit 30*b* extends outwardly relative to the main axis A from the right side of the opening 13 and protrudes in the X direction along the main axis A. The third positioning unit 30*c* extends outwardly relative to the main axis A from the left side of the opening 13 and protrudes in the X direction along the main axis A. In the embodiment, the first, second, and third positioning units 30*a*, 30*b*, and 30*c* are spaced apart from one another by 90 degrees in circumferential direction of the main axis A.

It should be noted that the number of positioning units of the switch control module 1 should not be limited to the embodiment. In some embodiments, the number of positioning units is arranged corresponding to the number of operation modes of the control assembly 20. In some other embodiments, the number of positioning units is greater than the number of operation modes of the control assembly 20. Moreover, while the first positioning unit 30*a*, the second positioning unit 30*b*, and the third positioning unit 30*c* are spaced from each other by the same angle, the spacing angle between the first positioning unit 30*a* and the second positioning unit 30*b* may differ from the spacing angle between the second positioning unit 30*b* and the third positioning unit 30*c*.

The features of the first, second, and third positioning units 30*a*, 30*b*, and 30*c* are elaborated in the following descriptions. In the embodiment shown in FIG. 1, since the first, second, and third positioning units 30*a*, 30*b*, and 30*c* have the same configuration, only the feature of the first positioning unit 30*a* is described, for the purpose of brevity. In the embodiment, the first positioning unit 30*a* includes two side walls 31. The two side walls 31 are spaced apart from one another. A groove 33 is defined between the two side walls 31. Each of the two side walls 31 includes a locking hole 32 in a position away from the opening 13. The locking holes 32 of the two side walls 31 are arranged corresponding to one another. In addition, as shown in FIG. 2, the first positioning unit 30*a* further includes a pivot point 34. The pivot point 34 is located in the edge of the opening 13 and protruding front the front surface 121 in the X direction.

As shown in FIGS. 1 and 2, the linkage unit L is configured to rotate the shaft 22 of the control assembly 20. In the embodiment, the linkage L includes a rod 40, an abutting structure 44, a sealing member 50, and a holding pin 60.

In the embodiment, the rod 40 extends along the main axis A and passes through the opening 13 of the panel 12. The first end 41 of the rod 40 includes an insetting hole 43 extending along the main axis A. The shaft 22 of the control assembly 20 is connected to the rod 40 via the inserting hole 43. The width of the shaft 22 is slightly less than the width of the inserting hole 43, so that the rod 40 is capable of sliding relative to the shaft 22 along the main axis A. The abutting structure 44 surrounds the outer side of the rod 40 and radially extends relative to the main axis A. The sealing member 50 surrounds the outer side of the rod 40 and is positioned between the abutting structure 44 and the rear surface 122 of the panel 12. The sealing member 50 is made of deformable elastic materials (such as rubber or the like).

While the holding pin 60 is pivoting relative to the rod 40 so as to enter one of the positioning units 30, the abutting structure 44 moves away from the control assembly 20 and toward the panel 12. As a result, the opening 13 is sealed.

Referring, to FIGS. 1 and 2, in the embodiment, the linkage unit L is connected to one of the first, second, and third positioning units 30*a*, 30*b*, and 30*c* by placing the linkage unit L into the groove 33. The rod 60 of the linkage unit L is pivotally connected to the second end 42 of the rod 40 and is able to pivot relative to the rod 40 about a pivoting axis P, which is perpendicular to the main axis A. Therefore, the rod 40 can be positioned in the groove 33 (see FIG. 1) of one of the first, second, and third positioning units 30*a*, 30*b*, and 30*c*. The groove 33 extends away from the opening 13 and radially extends relative to the main axis A. The holding pin 60 includes a through hole 61. When the holding pin 60 is positioned in the groove 33, the through hole 61 communicates with the locking holes 32 of the two side wall 31. A fastening member 70 (such as a lock) is selectively used to pass through the through hole 61 and the locking holes 32 to prevent the device from disassembling on purpose.

In the embodiment, the operation mode of the control assembly 20 is determined by the position of the holding pin 60 of the linkage unit L. For example, when the holding pin 60 is positioned in the first positioning unit 30*a*, the shaft 22 of the control assembly 20 is limited by the linkage unit L at an angle of 0 degrees, and the control assembly 20 is operated in a first operation mode. When the holding pin 60 is positioned in the second positioning unit 30*b*, the shaft 22 of the control assembly 20 is limited by the linkage unit L at an angle of 90 degrees, and the control assembly 20 is operated in a second operation mode. When the holding pin 60 is positioned in the third positioning unit 30*c*, the shaft 22 of the control assembly 20 is limited by the linkage unit L at an angle of −90 degrees, and the control assembly 20 is operated in a second operation mode.

In the embodiment, the method for switching the holding pin 60 from the first positioning unit 30*a* to the second positioning unit 30*b* is described below.

Figure 3:
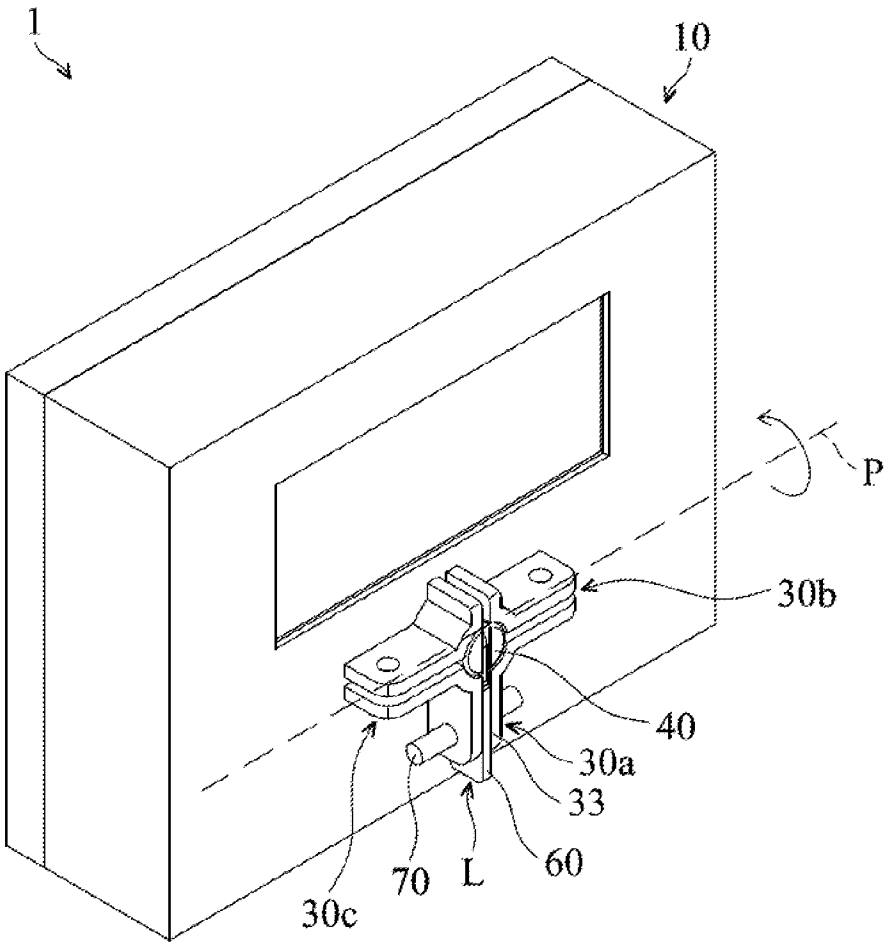
FIG. 3 shows a schematic dew of a stage of a method to use a switch control module, in accordance with one embodiment of the disclosure.
Figure 4:
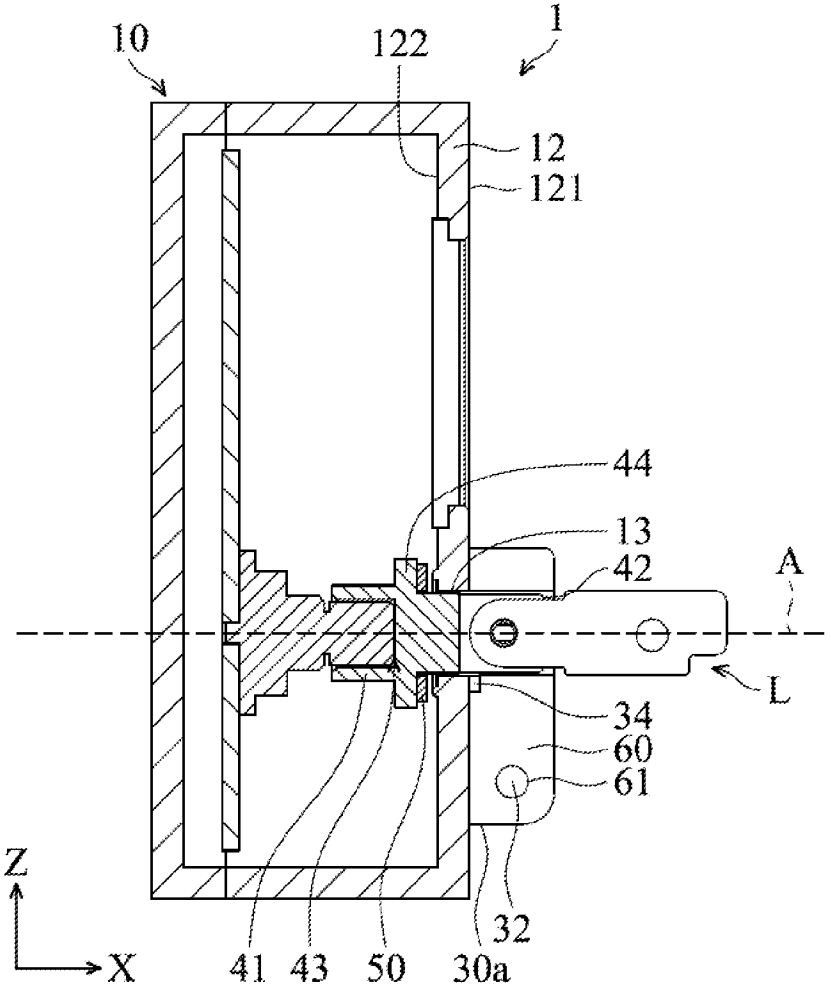
FIG. 4 shows a cross-sectional view of a switch control module with a linkage unit for controlling a setting of a control assembly, in accordance with one embodiment of the disclosure.

In the beginning, as shown in FIG. 3, the fastening member 70 is removed from the first positioning unit 30*a* and the holding pin 60. Afterwards, the holding pin 60 is pivoted about the pivoting axis P along the direction indicated by the arrow in FIG. 3 so as to move the holding pin 60 away from the groove 33 of the first positioning unit 30*a* and arrange the rod 40 to align with the main axis A. At this moment, as shown in FIG. 4, the sealing member 50 is not compressed by the abutting structure 44 or the rear surface 122 of the panel 12. As a result, the accommodating space 11 communicates with its surroundings via the opening 13. In the other embodiments, when the holding pin 60 is located on the main axis A, all the elements of the linkage unit L are moveable along the main axis A. In this case, the shaft 22 of the control assembly 20 can be pressed by producing a displacement of the linkage unit L after the rotating movement so as to change the setting of the control assembly 20.

Figure 5:
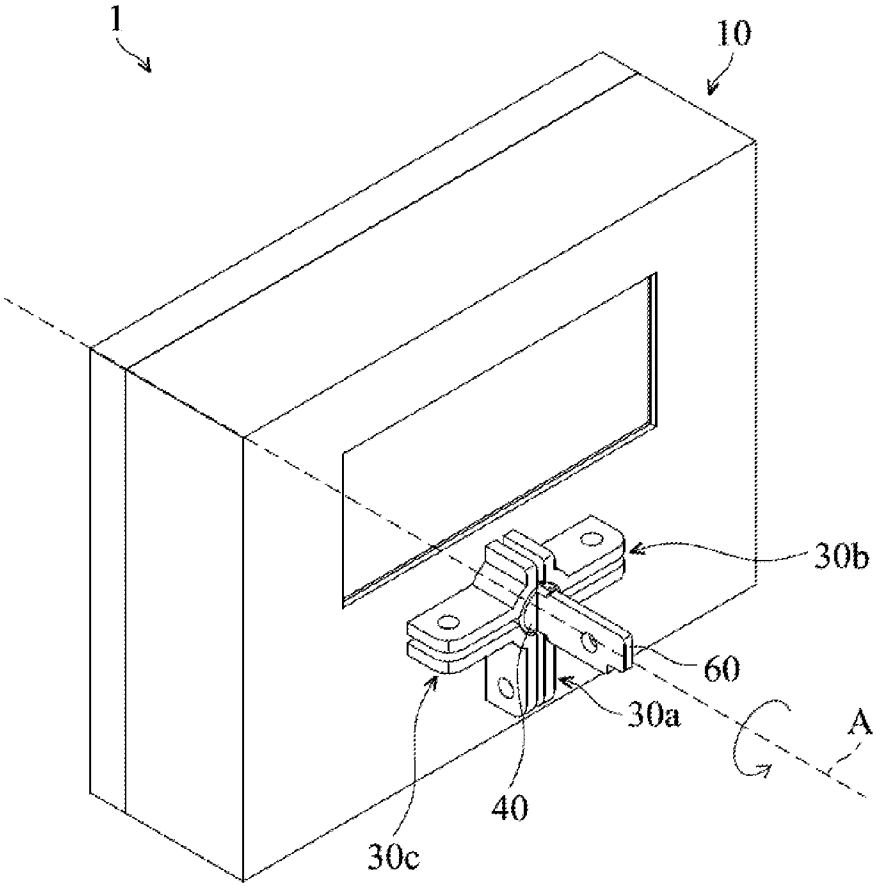
FIG. 5 shows a schematic view of a stage of a method to use a switch control module, in accordance with one embodiment of the disclosure.
Figure 6:
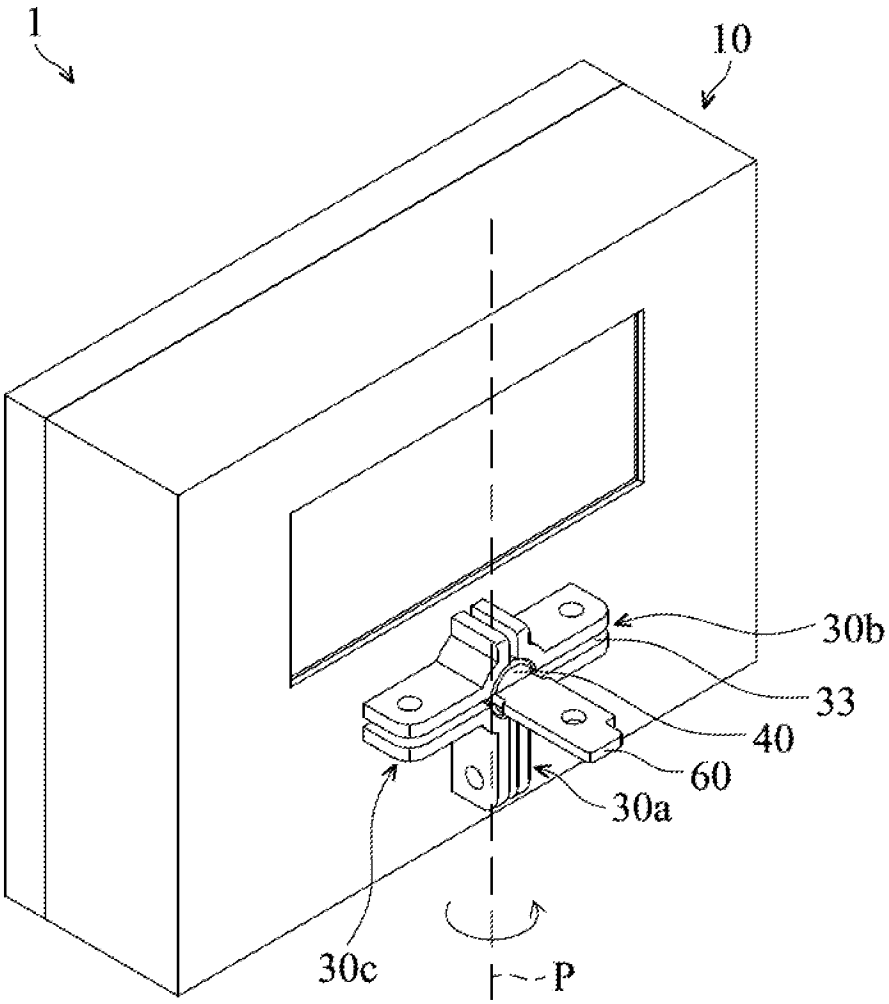
FIG. 6 shows a schematic view of a stage of a method to rise a switch control module, in accordance with one embodiment of the disclosure.
Figure 7:
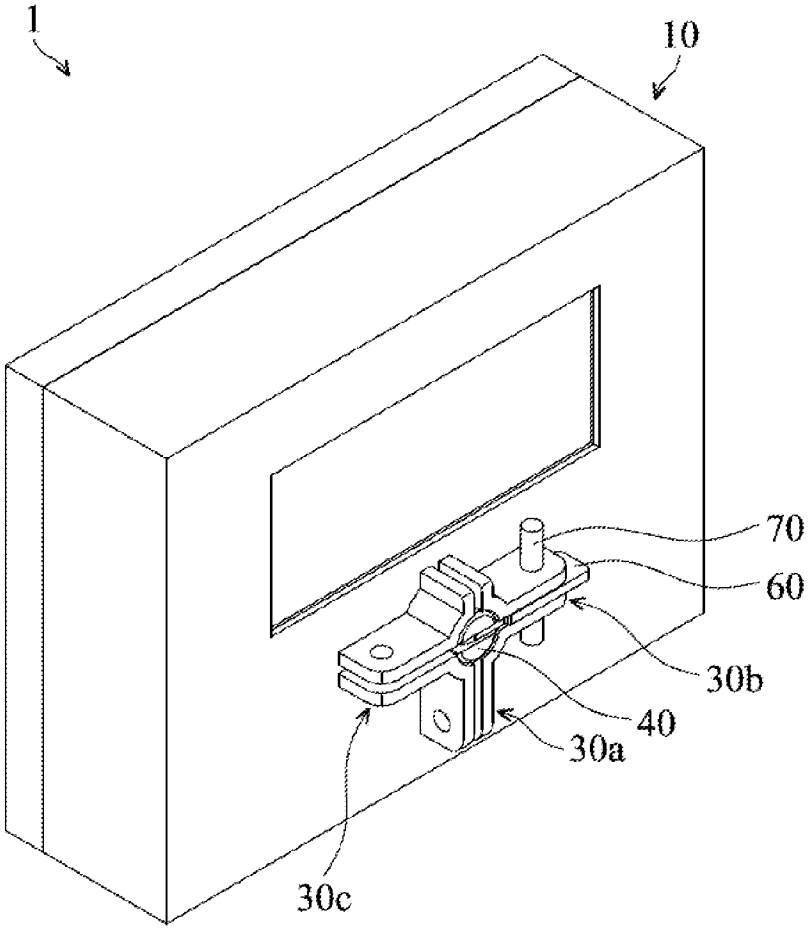
FIG. 7 shows a schematic view of a stage of a method to use a switch control module, in accordance with one embodiment of the disclosure.

Afterwards, the linkage unit L is rotated about the main axis A along the direction indicated by the arrow in FIG. 5 about an angle, for example, 90 degrees, to enable the holding pin 60 of the linkage unit A to be positioned corresponding to groove 33 of the second positioning unit 30*b*. During the rotation of the linkage unit L, the shaft 22 is driven by the linkage unit L to rotate and the control assembly 20 is switched to another operation mode. Afterwards, the holding pin 60 is pivoted about the pivoting axis P along the direction indicated by the arrow in FIG. 6 to position the holding pin 60 into the groove 33 of the second positioning unit 30*b*. Afterwards, the fastening member 70 is selectively used to fix the holding pin 60 at the second positioning unit 30*b* to limit the movement of the holding pin 60.

It should be noted that, while the holding pin 60 is being placed into the groove 33 of the second positioning unit 30*b*, the holding pin 60 abuts the pivot point 34 of the second positioning unit 30*b*, and the rod 40 is moved away from the shaft 22 along the main axis A by a moment. While at the same time, the sealing member 50 is compressed by the abutting structure 44 and the panel 12 to deform. As a result, the opening 13 is sealed by the sealing member 50. In the other embodiments, the sealing member 50 is omitted, the abutting structure 44 is made of deformable elastic material, and the opening. 13 is sealed by the abutting structure as the rod 40 is moved away from the shaft 22.

The switch control module of the disclosure uses a number of positioning units to facilitate the control assembly switching in different operation modes. In addition, since the linkage unit for controlling the control assembly can be fixed at one of the positioning units, the objective of preventing the device front being disassembled on purpose can be achieved. Moreover, while the linkage unit is being connected to the positioning unit, the linkage unit seals the opening of the housing which communicates with the outside, this feature also simplifies the process for sealing the housing. Besides, the elements positioned in the housing can be protected from being damage due to moisture.

While the invention has been described by way of example and in terms of preferred embodiment, it is to be understood that the invention is not limited thereto. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A switch control module, comprising:

a housing having a panel on a side of the housing, the panel having a front surface and a rear surface, the housing defining an accommodating space and having an opening penetrating from the front surface to the rear surface of the panel along a main axis;

a control assembly disposed in the accommodating space and comprising a shaft that is rotatable about the main axis;

a plurality of positioning units located at an edge of the opening and positioned on the front surface of the panel and spaced apart from one another, wherein the positioning units extend radially and outwardly with the main axis as a center and are projected in a direction along the main axis; and a linkage unit having a rod and a holding pin, wherein the rod passes through the opening and connected to the shaft in a movable manner, and the holding pin is pivotally connected with the rod and is selectively connected to one of the positioning units;

wherein the linkage unit is configured to drive the shaft to rotate so as to change the operation mode of the control module.

2. The switch control module as claimed in claim 1, wherein the rod has a first end and a second end opposite the first end, wherein the first end of the rod is connected to the shaft, and the second end of the rod passes through the opening and pivotally connected to the holding pin;

wherein the linkage unit has an abutting structure surrounding the rod, and while the holding pin is being placed into one of the positioning units, the abutting structure moves away from the control assembly so as to seal the opening.

3. The switch control module as claimed in claim 2, wherein the first end of the rod comprises an inserting hole extending along the main axis, and the shaft is connected to the rod via the inserting hole in such a way that it is capable of sliding along the main axis.

4. The switch control module as claimed in claim 2, wherein each of the positioning units comprises a locking hole, and the holding pin comprises a through hole, and when the holding pin is positioned in one of the positioning units, the through hole of the holding pin communicates with the locking hole of the corresponding positioning unit for facilitating an insertion of a fastening member to fix the holding pin in the corresponding positioning unit.

5. The switch control module as claimed in claim 2, wherein each of the positioning units comprises a pivot point located at the edge of the opening, and while the holding pin is being placed into one of the positioning units by pivoting the holding pin about the rod, the holding pin abuts the pivot point, and the rod is moved away from the shaft.

6. The switch control module as claimed in claim 2, wherein the linkage unit further comprises a sealing member arranged adjacent to the abutting structure and surrounding the rod, and when the holding pin is connected to one of the positioning units, the sealing member is compressed by the abutting structure so as to seal the opening.

7. The switch control module as claimed in claim 6, wherein the sealing member is made of deformable elastic material.

8. The switch control module as claimed in claim 1, wherein each of the positioning units comprises a groove extending away from the opening and radially extending relative to the main axis.

9. The switch control module as claimed in claim 8, wherein the linkage unit is connected to one of the positioning units by placing the linkage unit into the corresponding groove.

10. The switch control module as claimed in claim 1, wherein when the linkage unit is rotated relative to the control assembly, the linkage unit is disengaged from the positioning unit.

* * * * *